US005551463A

United States Patent [19]

Wang

[11] Patent Number: 5,551,463

[45] Date of Patent: Sep. 3, 1996

[54] SKELETON FOR A TELESCOPIC UMBRELLA

[76] Inventor: Mao S. Wang, P.O. Box 82-144, Taipei, Taiwan

[21] Appl. No.: 555,812

[22] Filed: Nov. 9, 1995

[51] Int. Cl.[6] ..... A45B 19/10

[52] U.S. Cl. ..... 135/25.3; 135/29; 135/31

[58] Field of Search ..... 135/25.3, 25.31, 135/29, 31, 22, 24, 23

[56] References Cited

U.S. PATENT DOCUMENTS

| | | | |
|---|---|---|---|
| 1,473,906 | 11/1923 | Hartzell | 135/25.31 |
| 1,567,861 | 12/1925 | Rothschild | 135/29 |
| 2,649,103 | 8/1953 | Militano | 135/25.31 |
| 4,149,553 | 4/1979 | Lee | 135/24 |
| 4,986,294 | 1/1991 | Wu | 135/29 X |
| 5,048,550 | 9/1991 | Su | 135/25.3 |
| 5,390,686 | 2/1995 | Lin et al. | 135/24 |

*Primary Examiner*—Lanna Mai

*Attorney, Agent, or Firm*—Alfred Lei

[57] ABSTRACT

A skeleton for telescopic umbrella including a shank having a tab, a ring slidably fitted on said shank and having a slot adapted to receive the tab, a fixed collar fixedly mounted at an upper end of the shank, a plurality of expanders pivotally connected with the fixed collar at an end, a plurality of supporters each pivotally connected with a first intermediate portion of one of the expanders at an end, a plurality of first joints each pivotally connected with another end of respective one of the supporters, a plurality of first ribs pivotally connected with the fixed collar at an end and pivotally connected with the first joints at another end, each of the first ribs being pivotally connected with another end of the expanders at a second intermediate portion, a plurality of second ribs fixedly connected with respective first joints at an end, a plurality of second joints each pivotally connected with another end of the second ribs, a plurality of third ribs pivotally connected with respective second joints at an end, and a plurality of pulling means each including a connecting rod, a spring and a curved plate.

2 Claims, 5 Drawing Sheets

PRIOR ART

SKELETON FOR A TELESCOPIC UMBRELLA

BACKGROUND OF THE INVENTION

1. Field of the Invention

This invention relates to an improved skeleton for a telescopic umbrella.

2. Description of the Prior Art

It has been found that none of the conventional skeletons for telescopic umbrellas are satisfactory in use. Referring to FIG. 4, there is shown a first prior art skeleton for telescopic umbrellas. As illustrated, the skeleton includes a locking means A1, a fixed collar A2, a plurality of expanders A4, a plurality of supporters A5, a plurality of first ribs A3, a plurality of second ribs A6, and a plurality of third ribs A7. However, the third ribs A7 are easily folded upward in case of strong wind thereby making it inconvenient to use. Hence, an improved skeleton (see FIGS. 5 and 5A) for telescopic umbrellas has been developed to eliminate this drawbacks. As shown in FIGS. 5 and 5A, the third rib B1 is provided with a pair of protuberances B11 which are adapted to engage with corresponding slots B21 of a joint B2. Although this means may keep the third ribs in position, it will also make it difficult to open and fold up the umbrella thus making it unfit for practical use.

Therefore, it is an object of the present invention to provide an improved skeleton for a telescopic umbrella which can obviate and mitigate the above-mentioned drawbacks.

SUMMARY OF THE INVENTION

This invention relates to an improved skeleton for a telescopic umbrella.

It is the primary object of the present invention to provide a skeleton for a telescopic umbrella which can prevent the canopy from folding upward.

It is another object of the present invention to provide a skeleton for a telescopic umbrella which is easy to collapse.

It is still another object of the present invention to provide a skeleton for a telescopic umbrella which is simple in construction.

It is still another object of the present invention to provide a skeleton for a telescopic umbrella which is low in cost.

It is a further object of the present invention to provide a skeleton for a telescopic umbrella which is fit for practical use.

Other objects of the invention will in part be obvious and in part hereinafter pointed out.

The invention accordingly consists of features of constructions and method, combination of elements, arrangement of parts and steps of the method which will be exemplified in the constructions and method hereinafter disclosed, the scope of the application of which will be indicated in the claims following.

DETAILED DESCRIPTION OF THE PREFERRED EMBODIMENT

Figures 1, 1A, 1B:
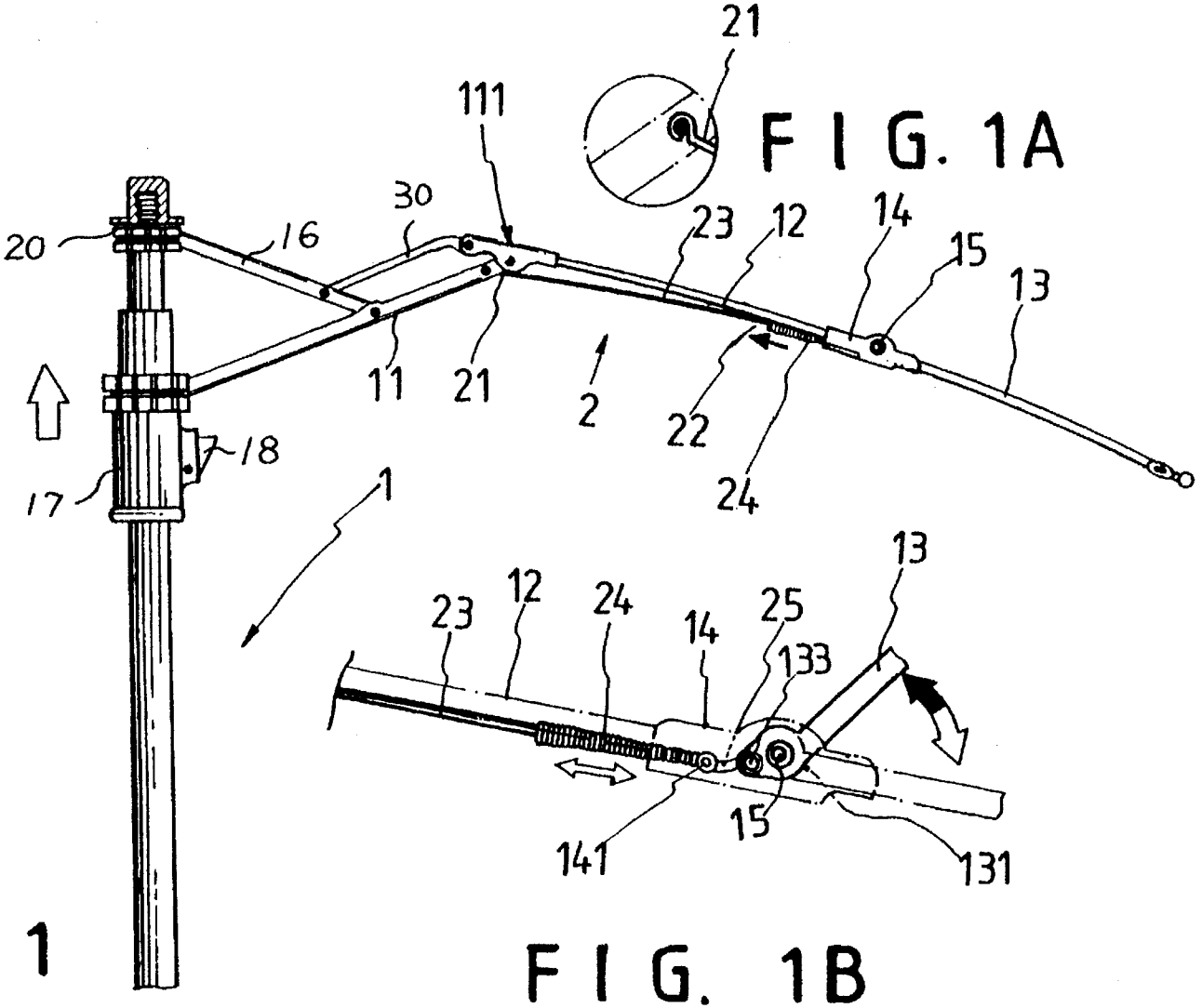
FIG. 1 illustrates a skeleton for a telescopic umbrella according to the present invention.
FIG. 1A is an enlarged view of an end of connecting rod.
FIG. 1B is an enlarged view of the pulling means.

For the purpose to promoting an understanding of the principles of the invention, reference will now be made to the embodiment illustrated in the drawings. Specific language will be used to describe same. It will, nevertheless, be understood that no limitation of the scope of the invention is thereby intended, such alternations and further modifications in the illustrated device, and such further applications of the principles of the invention as illustrated herein being contemplated as would normally occur to one skilled in the art to which the invention relates.

Figure 2:
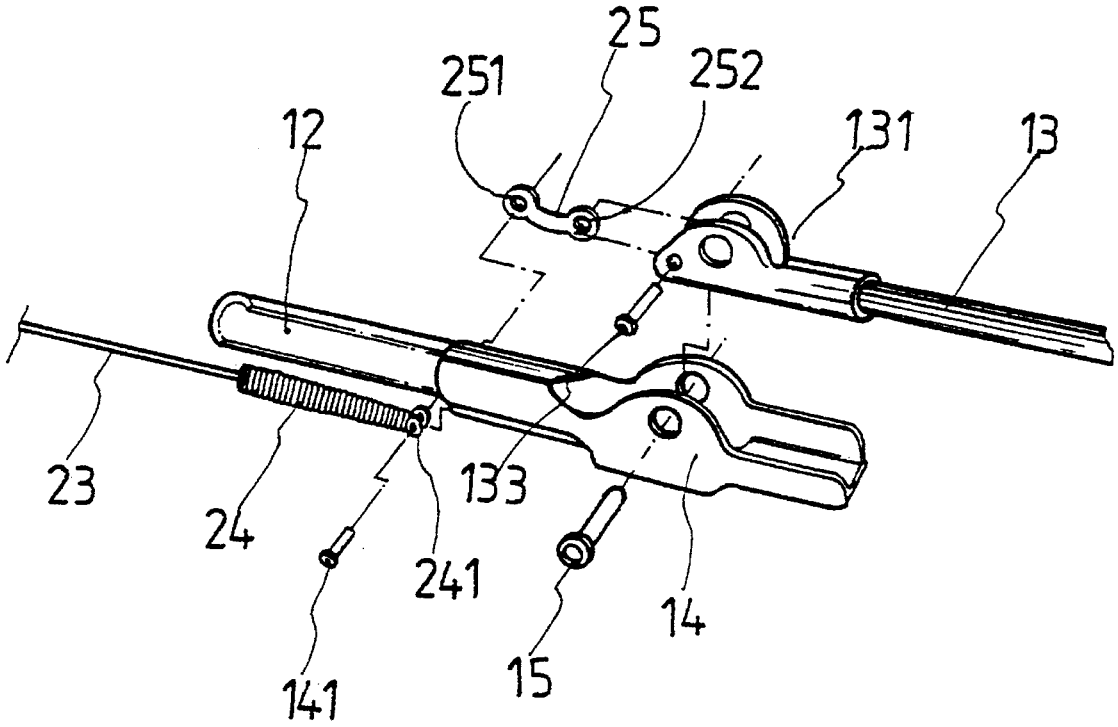
FIG. 2 is an exploded view illustrating the connection between the pulling means and the third rib.
Figure 3:
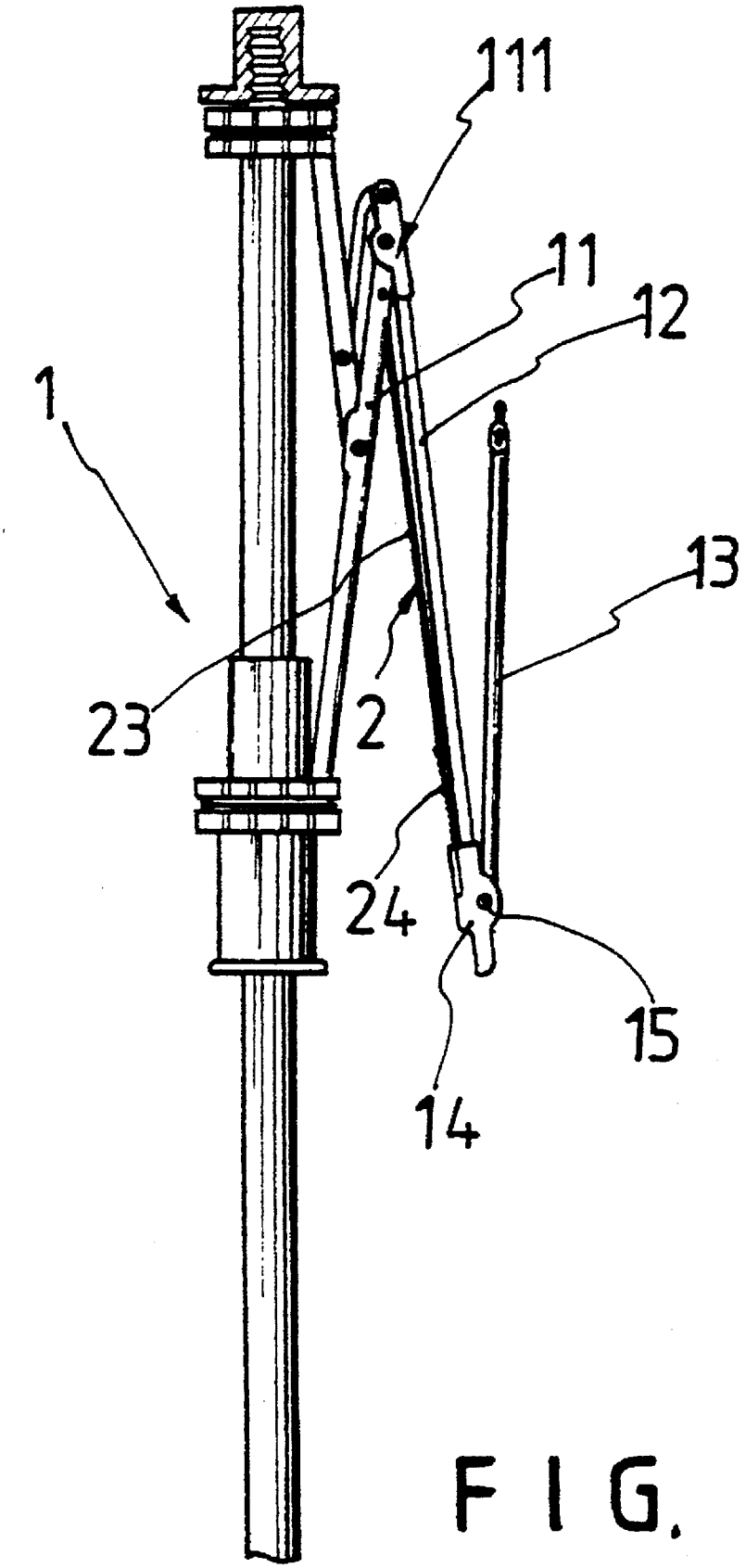
FIG. 3 illustrates the collapsed condition of the skeleton.
Figure 4:
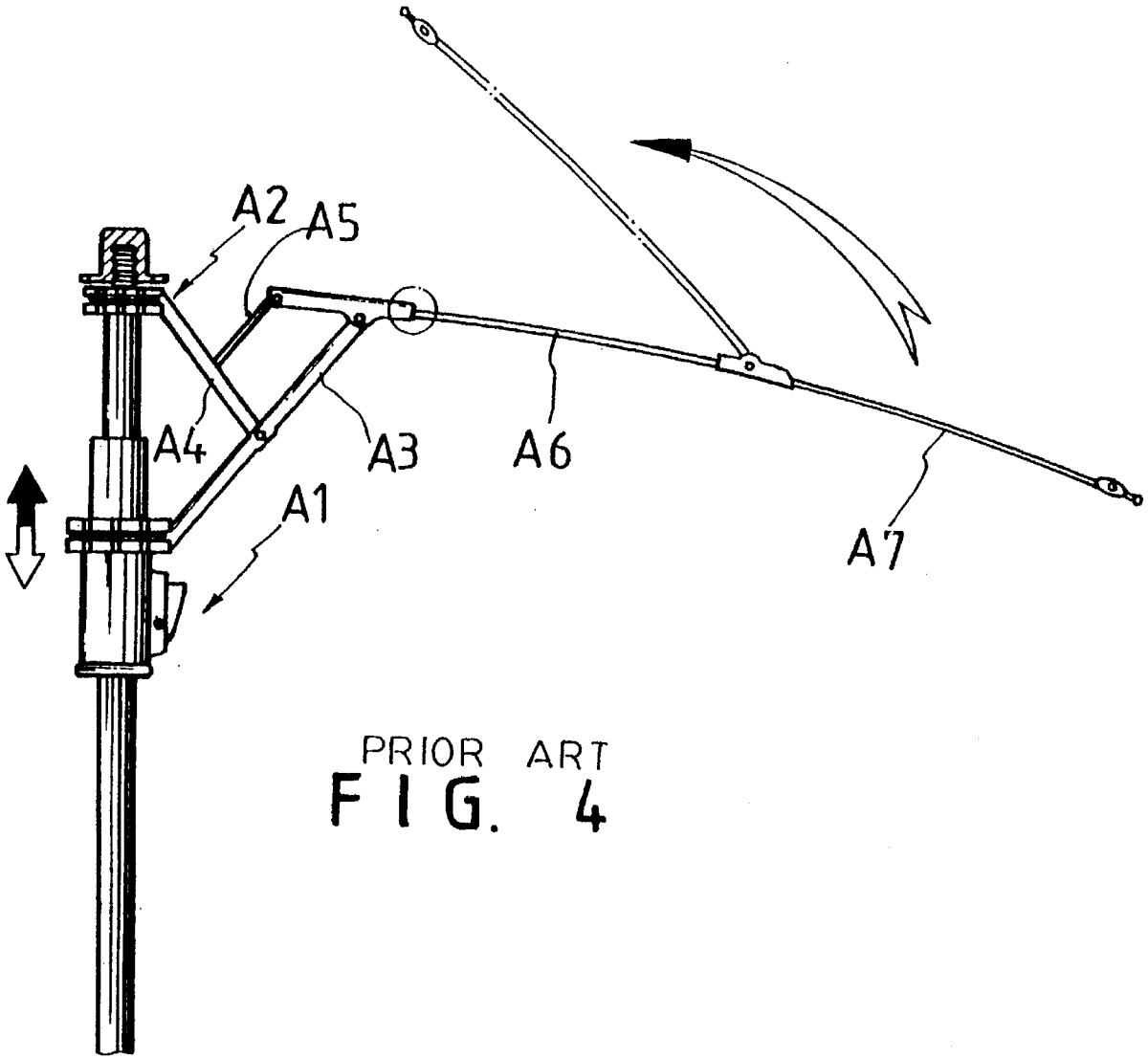
PRIOR ART FIG. 4
FIG. 4 shows a prior art skeleton for a telescopic umbrella.
Figures 5, 5A:
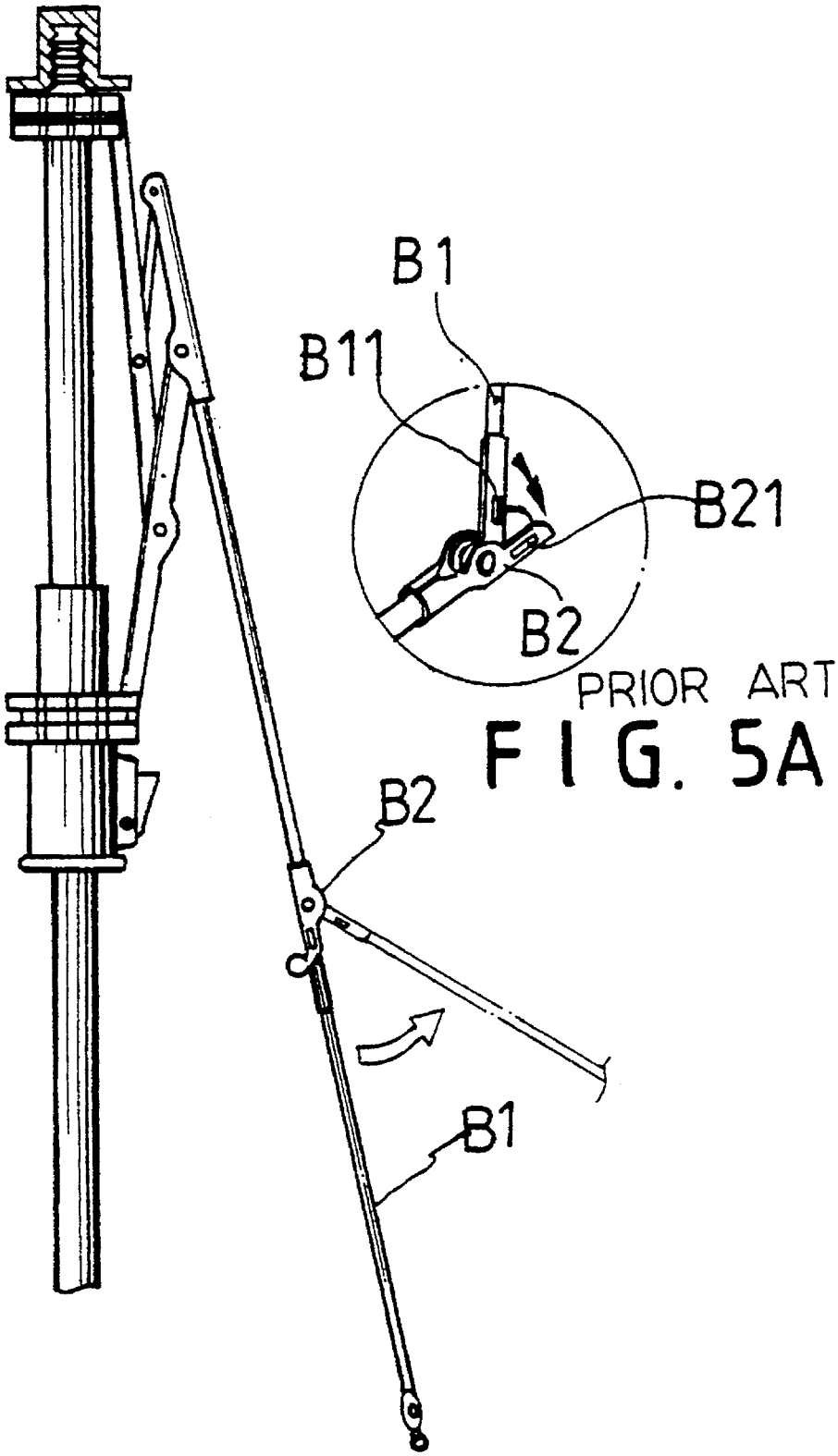
FIG. 5A PRIOR ART
FIG. 5 shows a second prior art skeleton for a telescopic umbrella.
FIG. 5A is an enlarged fragmentary view of FIG. 5.

With reference to the drawings and in particular to FIGS. 1, 2 and 3 thereof, the skeleton for a telescopic umbrella according to the present invention mainly comprises a shank 19, a ring 17, a fixed collar 20, a plurality of expanders 16, a plurality of supporters 30, a plurality of first joints 111, a plurality of first ribs 11, a plurality of second ribs 12, a plurality of third ribs 13, a plurality of second joints 14, and a plurality of pulling means 2.

The shank 19 is an elongated member provided with a tab 18 which can be pressed down into the shank 19 by an external force. The structure of the tab 18 may be of any conventional design which is well known to those skilled in the art and is not considered a part of the invention.

The fixed collar 20 is fixedly mounted at the upper end of the shank 19.

The ring 17 is slidably fitted on the shank 19 and has a slot (not shown) adapted to engage with the tab 18.

The first ribs 11 are pivotally connected with ring 17 at one end, each of which is pivotally connected with a first joint 111 at the other end.

The expanders 16 are pivotally connected with the fixed collar at one end, each of which is pivotally connected with an intermediate portion of a first ribs 11 at the other end.

The supporters 30 are each pivotally connected an intermediate portion of an expander 16 at one end and pivotally connected with a first joint 111 at the other end.

The second ribs 12 are each fixedly connected with a first joint 111 at one end and a second joint 14 at the other end.

The third ribs 13 are pivotally connected with a second joint 14 at an end.

The pulling means 2 includes a plurality of connecting rods 23 each having an end 21 pivotally connected with a first rib 11, and a plurality of springs 24 having a first end fixedly connected with the other end of a rod 23 and a second end 241 pivotally connected with an end 251 of a curved plate 25 by a pin 141. The other end 252 of the curved plate 25 is pivotally connected with a connector 131 by a pin 133. The connector 131 is fixedly connected with an end of a third rib 13 and is pivotally connected with a second joint 14 by a pin 15.

When the skeleton 1 is open (see FIG. 1), the pulling means 2 will exert a force on the third rib 13 thereby keeping the third rib 13 in position and therefore preventing the third rib 13 from folding upward. As the skeleton 1 is collapsed, the pulling means 2 will no longer be stretched and the third rib 13 can be easily collapsed.

The invention is naturally not limited in any sense to the particular features specified in the forgoing or to the details of the particular embodiment which has been chosen in order to illustrate the invention. Consideration can be given to all kinds of variants of the particular embodiment which has been described by way of example and of its constituent elements without thereby departing from the scope of the invention. This invention accordingly includes all the means constituting technical equivalents of the means described as well as their combinations.

I claim:

1. A skeleton for telescopic umbrella comprising:

a shank having a tab;

a ring slidably fitted on said shank and having a slot adapted to receive said tab;

a fixed collar fixedly mounted at an upper end of said shank;

a plurality of expanders pivotally connected with said fixed collar at an end;

a plurality of supporters each pivotally connected with a first intermediate portion of one of said expanders at an end;

a plurality of first joints each pivotally connected with another end of respective one of said supporters;

a plurality of first ribs pivotally connected with said fixed collar at an end and pivotally connected with said first joints at another end, each of said first ribs being pivotally connected with another end of said expanders at a second intermediate portion;

a plurality of second ribs fixedly connected with respective first joints at an end;

a plurality of second joints each pivotally connected with another end of said second ribs;

a plurality of third ribs pivotally connected with respective second joints at an end; and a plurality of pulling means each including a connecting rod, a spring and a curved plate, said connecting rod having an end pivotally connected with one of said first ribs and another end fixedly connected with an end of said spring, another end of said spring being pivotally connected with an end of said curved plate, another end of said curved plate being fixedly connected with a connector, said connector being fixedly connected with an end of one of said third ribs and being pivotally connected with one of said second joints.

2. The skeleton for an umbrella as claimed in claim 1, wherein said pulling means are fitted within said second ribs.

* * * * *